US010641455B2

(12) United States Patent
Mayer et al.

(10) Patent No.: US 10,641,455 B2
(45) Date of Patent: May 5, 2020

(54) MOTOR VEHICLE LIGHTING UNIT WITH HEAT SINK

(71) Applicant: ZKW GROUP GMBH, Wieselburg (AT)

(72) Inventors: Matthias Mayer, Mank (AT); Markus Reinprecht, Pielachhauser (AT); Stefan Mitterlehner, Mank (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 16/074,193

(22) PCT Filed: Jan. 13, 2017

(86) PCT No.: PCT/AT2017/060005
§ 371 (c)(1),
(2) Date: Jul. 31, 2018

(87) PCT Pub. No.: WO2017/132713
PCT Pub. Date: Aug. 10, 2017

(65) Prior Publication Data

US 2019/0316751 A1 Oct. 17, 2019

(30) Foreign Application Priority Data

Feb. 2, 2016 (AT) ..... 50059/2016

(51) Int. Cl.
*F21S 41/00* (2018.01)
*F21S 41/675* (2018.01)
(Continued)

(52) U.S. Cl.
CPC ..... *F21S 41/675* (2018.01); *F21S 45/43* (2018.01); *F21S 45/46* (2018.01); *F21S 41/141* (2018.01); *F21Y 2115/10* (2016.08)

(58) Field of Classification Search
CPC ..... F21S 41/30–365; F21S 41/67–68; F21S 45/40–465
See application file for complete search history.

(56) References Cited

U.S. PATENT DOCUMENTS 9,901,013 B2 * 2/2018 Shedd ..... H05K 7/20809
2009/0129092 A1 * 5/2009 Chen ..... F21V 15/01 362/294
(Continued)

FOREIGN PATENT DOCUMENTS

DE 102007040728 A1 3/2009
DE 102007043961 A1 3/2009
(Continued)

OTHER PUBLICATIONS

Search Report issued in Austrian Application No. A 50059/2016, dated Dec. 6, 2016 (1 page).
(Continued)

*Primary Examiner* — Gerald J Sufleta, II
(74) *Attorney, Agent, or Firm* — Eversheds Sutherland (US) LLP

(57) ABSTRACT

The invention relates to a lighting unit (1) for a motor vehicle, which comprises a light module (2) and a mirror module (3), wherein the mirror module (3) is designed to reflect the light emission produced by the light module (3) in an emission direction of the lighting unit (1), characterized by: the light module (2), which comprises at least one light source (4) and a first heat sink (5), the mirror module (3), which comprises a mirror unit (6) and a second heat sink (7), a cooling system (8), which comprises at least one inlet (9), at least one outlet (10), at least one line (11), at least one flow unit (12), a cooling medium, a first cooling sink, and a second cooling sink, wherein the inlet (9) and the outlet (10) are connected by the line (11), and the flow unit (12) is inserted into the line (11) in order to produce a flow of the
(Continued)

Figure 1:
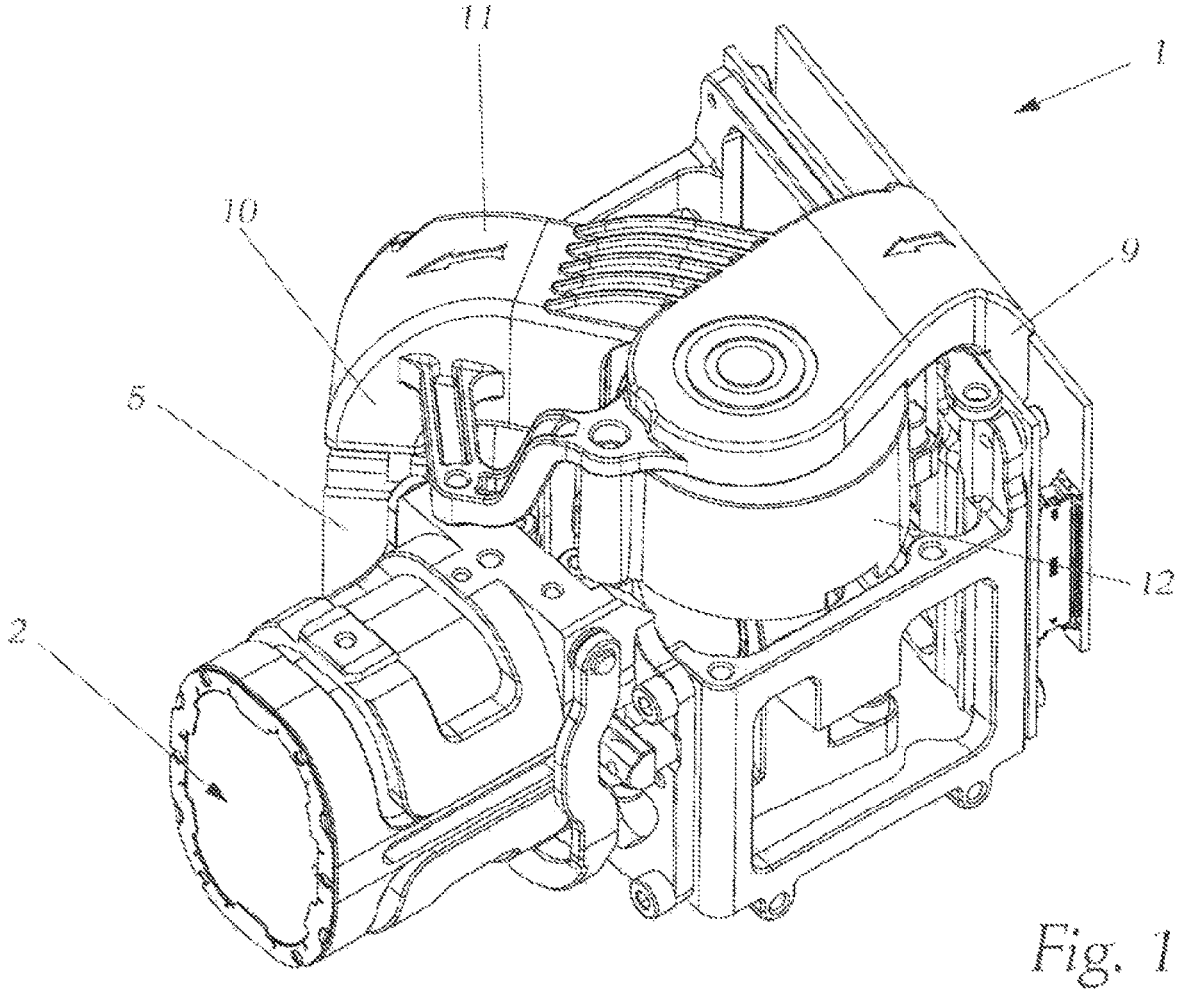

cooling medium in the line (11) and sucks in the cooling medium through the inlet (9) and discharges the cooling medium through the outlet (10), and the first cooling sink is formed by the first heat sink (5) of the light module (2) and the second cooling sink is formed by the second heat sink (7) of the mirror module (3), wherein the first cooling sink is arranged downstream of the second cooling sink.

13 Claims, 4 Drawing Sheets

(51) Int. Cl.

| | |
|---|---|
| ***F21S 45/46*** | (2018.01) |
| ***F21S 45/43*** | (2018.01) |
| *F21Y 115/10* | (2016.01) |
| *F21S 41/141* | (2018.01) |

(56) References Cited

U.S. PATENT DOCUMENTS

2011/0249460 A1 10/2011 Kushimoto
2012/0026745 A1* 2/2012 Cheng ..... F21V 29/006 362/373
2012/0127747 A1 5/2012 Ahn et al.
2013/0038736 A1* 2/2013 Yamamura ..... H04N 7/183 348/148
2013/0186596 A1* 7/2013 Rubenstein ..... F28D 15/0275 165/104.17
2014/0071706 A1* 3/2014 Yagi ..... F21S 41/285 362/520
2015/0009702 A1* 1/2015 Fiederling ..... F21V 23/008 362/547
2015/0016133 A1* 1/2015 Erdl ..... F21S 45/47 362/510
2015/0098235 A1* 4/2015 Singh ..... F21S 41/147 362/516
2015/0354776 A1* 12/2015 Lai ..... F21V 29/51 362/487
2016/0169497 A1* 6/2016 Kratochvil ..... B60Q 1/06 362/547
2016/0208997 A1* 7/2016 Silvi ..... F21S 41/141
2016/0341390 A1 11/2016 Yamamura et al.
2019/0072264 A1* 3/2019 Nagatani ..... F21V 29/71

FOREIGN PATENT DOCUMENTS

DE 102014110605 A1 1/2016
JP 2000-352762 A 12/2000

OTHER PUBLICATIONS

International Search Report for PCT/AT2017/060005, dated May 10, 2017 (3 pages).

* cited by examiner

MOTOR VEHICLE LIGHTING UNIT WITH HEAT SINK

The invention relates to a lighting unit for a motor vehicle, which comprises a light module and a mirror module, wherein the mirror module is adapted to reflect the light emission produced by the light module in the emission direction of the lighting unit.

When developing the present headlamp systems, the focus is increasingly on the desire to be able to project onto the roadway a light image with the highest possible resolution which can be changed rapidly and adapted to the respective traffic, road and light conditions. The term "roadway" is used here for a simplified representation since it naturally depends on the local conditions whether a light image is actually located on the roadway or also extends beyond this. In principle, the light image in the sense used corresponds to a projection onto a vertical surface according to the relevant standards which relate to motor vehicle lighting technology.

In order to meet this said requirement, lighting units have been developed inter alia which form a variably controllable reflector surface from a multiplicity of micromirrors and reflect a light emission generated by a light source in the emission direction of the lighting unit. Such lighting devices are advantageous in vehicle construction with regard to their highly flexible light distribution since the illuminance can be regulated individually for each pixel and arbitrary light distributions can be achieved, such as for example a dimmed beam light distribution, a cornering light distribution, a city light distribution, a motorway light distribution, a bending light distribution, a full beam light distribution or the imaging of dazzle-free full beam.

The so-called digital light processing (DLP®) projection technology is used for the micro-mirror arrangement in which images are produced by modulating a digital image onto a light beam. In this case, as a result of a rectangular arrangement of movable micromirrors, the light beam is decomposed into pixels and then reflected in pixels either into the projection path or out from the projection path. The basis for this technology is formed by a component which contains a rectangular arrangement in the form of a matrix of mirrors and their control technology and which is designated as "digital micromirror device" (DMD).

A DMD microsystem comprises a surface light modulator (spatial light modulator, SLM) which consists of micromirror actuators arranged in matrix form, that is tiltably reflecting surfaces having an edge length of about 16 μm. The movement is brought about by the force effect of electrostatic fields. Each micromirror is adjustable individually in angle and usually has two stable end states, between which it is possible to change up to 500 times within a second. The number of mirrors corresponds to the resolution of the projected image, wherein a mirror can form one or more pixels. DMD chips having high resolutions in the megapixel range are now available. The technology forming the basis of the adjustable individual mirrors is micro-electrical mechanical systems (MEMS) technology.

Whereas DMD technology has two stable mirror states and the reflections can be adjusted by a modulation between two stable states, "analog micromirror device" (AMD) technology has the property that the individual micromirrors can be adjusted in variable mirror positions.

An essential aspect in the design of a vehicle headlamp or a lighting unit with DLP® technology is the necessary cooling of the micromirror component. During illumination of the component with light, approximately 90% of the light is reflected as intended but approximately 10% is absorbed by the component as reflection loss and converted into heat. The efficiency is predominantly determined by the fact that the individual mirror have a distance from one another in order to be movable. The area between the individual micromirrors is irradiated by the light and heat is thereby absorbed. The heat must be suitably removed, for example, by a cooling system.

In addition, the light which is not reflected in the emission direction of the lighting unit must be suitably absorbed.

An object of the present invention lies in providing a lighting unit with a micromirror component and a cooling system which is particularly cost-effective, compact and effective.

This object is solved by a lighting unit of the type mentioned initially in that the lighting unit is characterized by:

- the light module which comprises at least one light source and a first heat sink,
- the mirror module which comprises a mirror unit and a second heat sink,
- a cooling system which comprises at least one inlet, at least one outlet, at least one line, at least one flow unit, a cooling medium, a first cooling sink and a second cooling sink, wherein inlet and outlet are connected by the line and the flow unit is inserted into the line in order to produce a flow of the cooling medium in the line and thereby sucks in the cooling medium through the inlet and expels it through the outlet again and the first cooling sink is formed by the first heat sink of the light module and the second cooling sink is formed by the second heat sink of the mirror module, wherein the first cooling sink is arranged downstream of the second cooling sink.

The invention uses the fact that both the mirror unit and also the light source itself are cooled and the advantages according to the invention can be achieved by the concept of a joint cooling of these two spatially separate cooling sinks.

The suitable choice in the sequence of the cooling sinks proves to be particularly effective. Even semiconductor light sources have a high efficiency compared to conventional light sources of presently about 30%, nevertheless a considerable proportion of the absorbed power is converted into heat. As mentioned previously, micromirror components convert about 10% of the emitted light energy into thermal energy. Consequently, it is particularly favourable in the case of a single-circuit cooling system comprising both cooling sinks to firstly cool the mirror module and then the light module in order not to raise the temperature of the mirror module unnecessarily to the waste heat temperature of the light module. In addition, the waste heat temperature of the mirror module barely adversely affects the light module. According to the efficiencies given previously as numerical examples, the power loss of the light module is obtained as 70% of the light source power and the power loss of the mirror module is 3% of the light source power, determined from 30% (generated light power) multiplied by 10% (mirror losses).

Since the mirror module reacts substantially more sensitively to a high operating temperature than the light module due to the integrated electronics, the selected sequence is particularly suitable, with the result that a favourable influence inter alia on a higher lifetime of the electronics is obtained.

It is advantageous with regard to the compact structure of the lighting unit if the flow unit is inserted into the line between the first heat sink and the second heat sink.

It is additionally favourable if the first heat sink (5) is inserted in the line upstream of the outlet or is arranged downstream of the outlet in such a manner that the first heat sink is cooled by the expelled cooling medium.

The same applies if the second heat sink in inserted in the line downstream of the inlet or is arranged upstream of the inlet in such a manner that the second heat sink is cooled by the sucked in cooling medium.

Depending on the necessary cooling power, it can be advantageous if the line of the cooling system runs through the first heat sink of the light module or rests on this. Likewise if the line of the cooling system runs through the second heat sink of the mirror module or rests on this.

The use of the arrangement according to the invention is particularly favourable if the first heat sink of the light module is structurally separated from the second heat sink of the mirror module. A common heat sink would be unfavourable for the operating temperature of the mirror module.

Both air, for example ambient air and also a fluid (e.g. cooling liquid or oil) can be selected as cooling medium and accordingly a fan or a pump can be selected as the flow unit. Frequently a circuit is provided for the cooling medium by connecting inlet and outlet to one another and inserting another cooling sink in the circuit. The selection is made according to a required cooling power which inter alia depends on the light source used and a required light power as well as on cost parameters. The line can then be designed as an air guide or as a liquid line.

The single-circuit structure of the cooling system results in cost advantages, a reduced number of system components and a compact design.

It is particularly advantageous to use a semiconductor light source in the light module in order to reduce the generation of waste heat there and consequently be able to make the cooling system compact and cost-effective. Examples for this are power LEDs and semiconductor lasers.

It is favourable to use a digital or analogue micro-mirror array (DMD or AMD) in the mirror unit in order to obtain a favourable reflection efficiency and consequently also be able to reduce the generation of waste heat there and make the cooling system compact and cost-effective.

Figure 2:
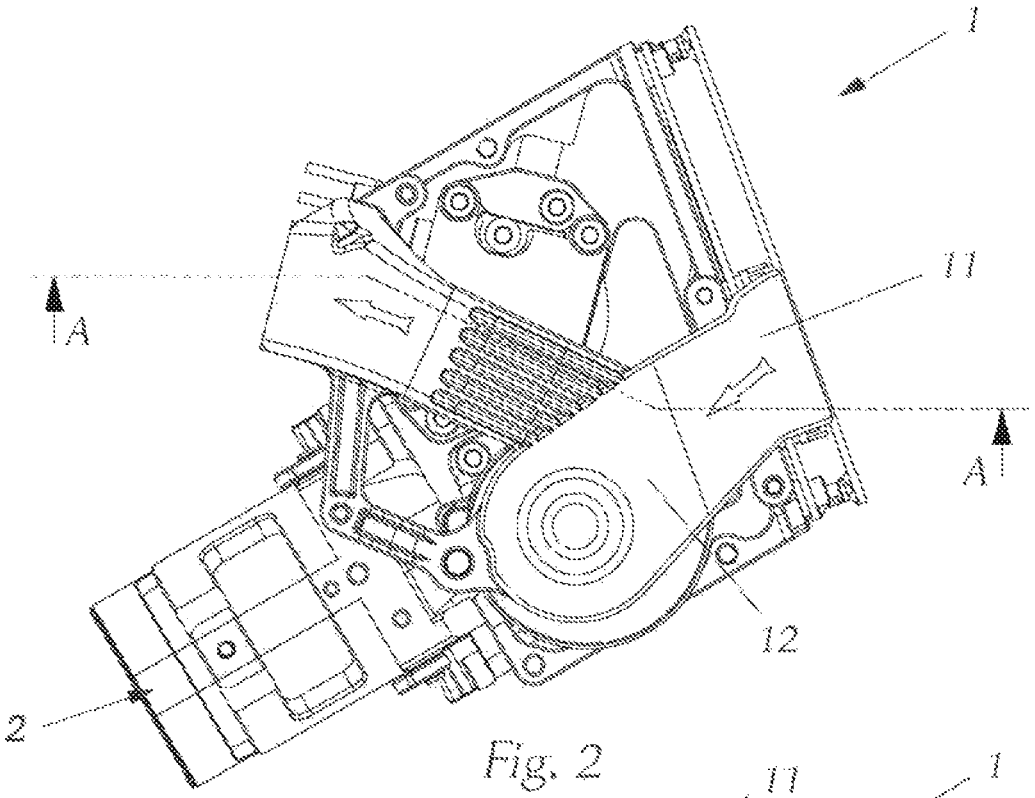
Figure 3:
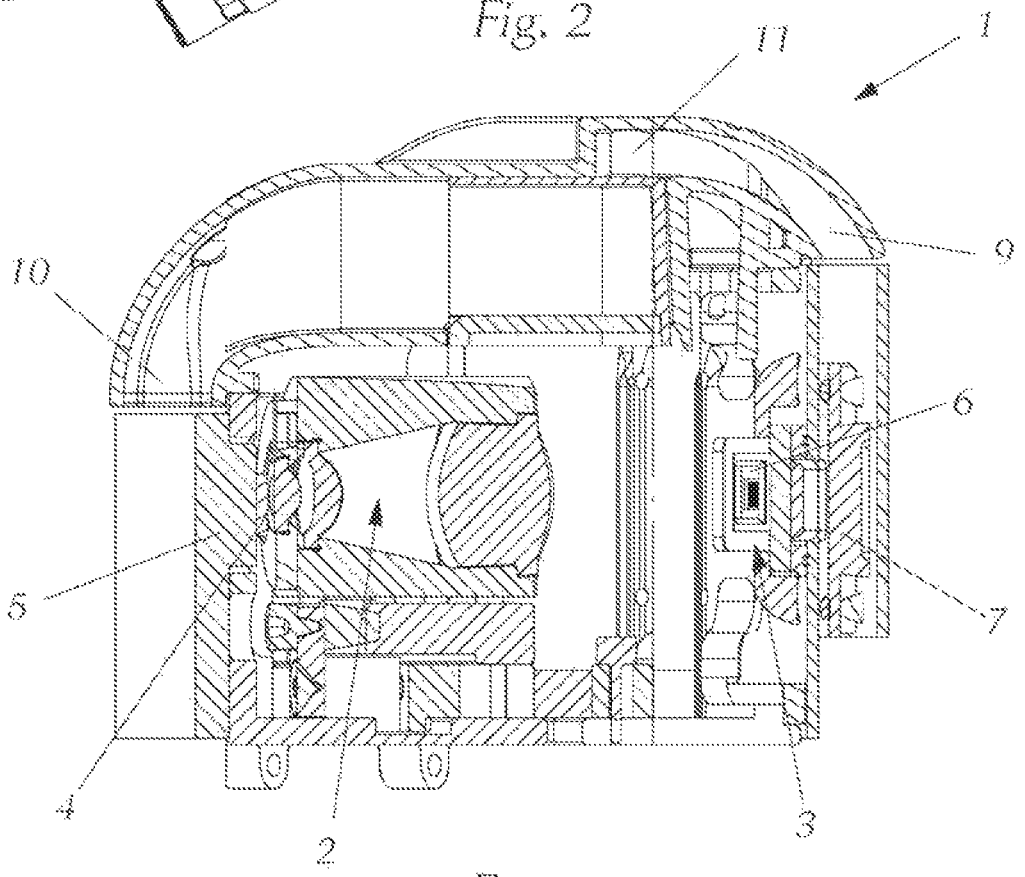
Figure 4:
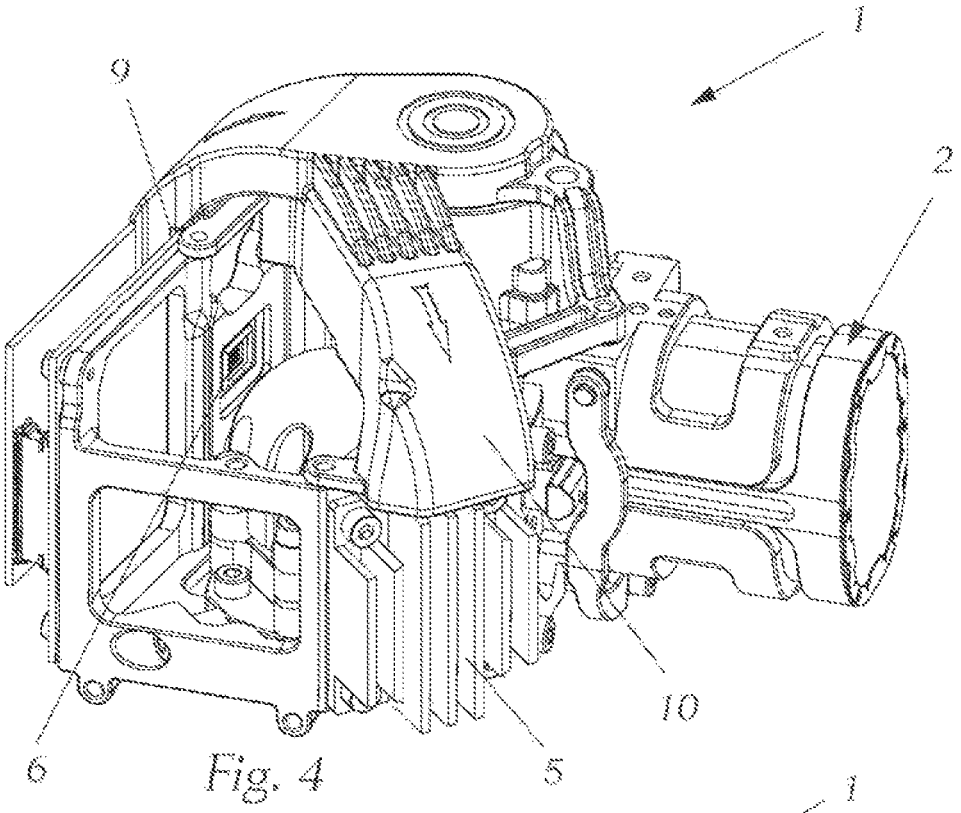
Figure 5:
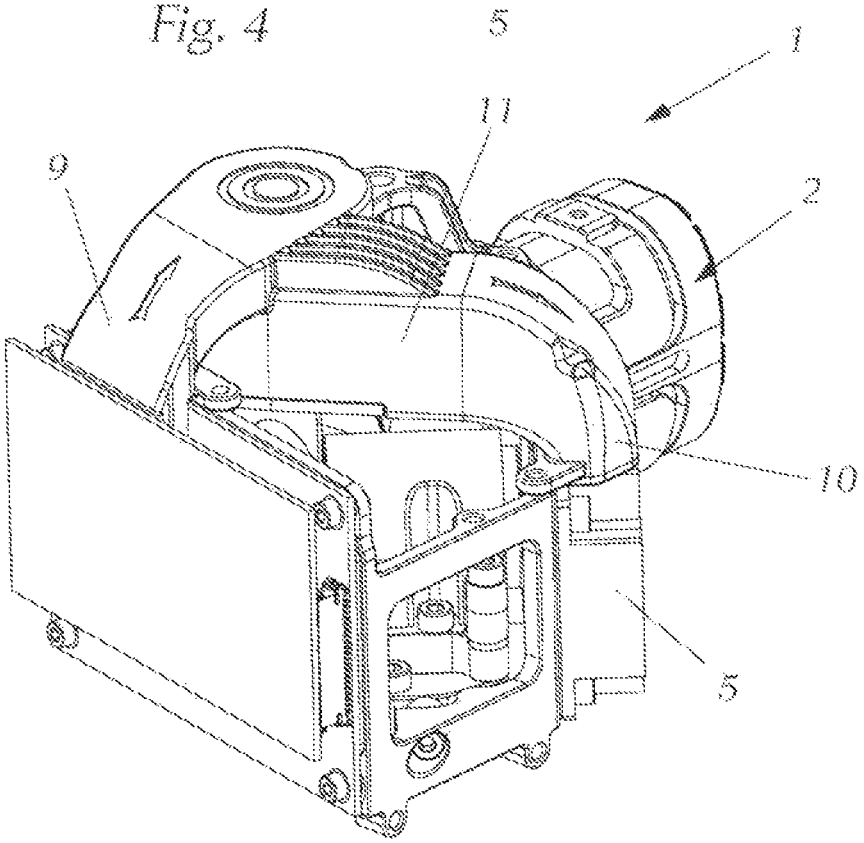
Figure 6:
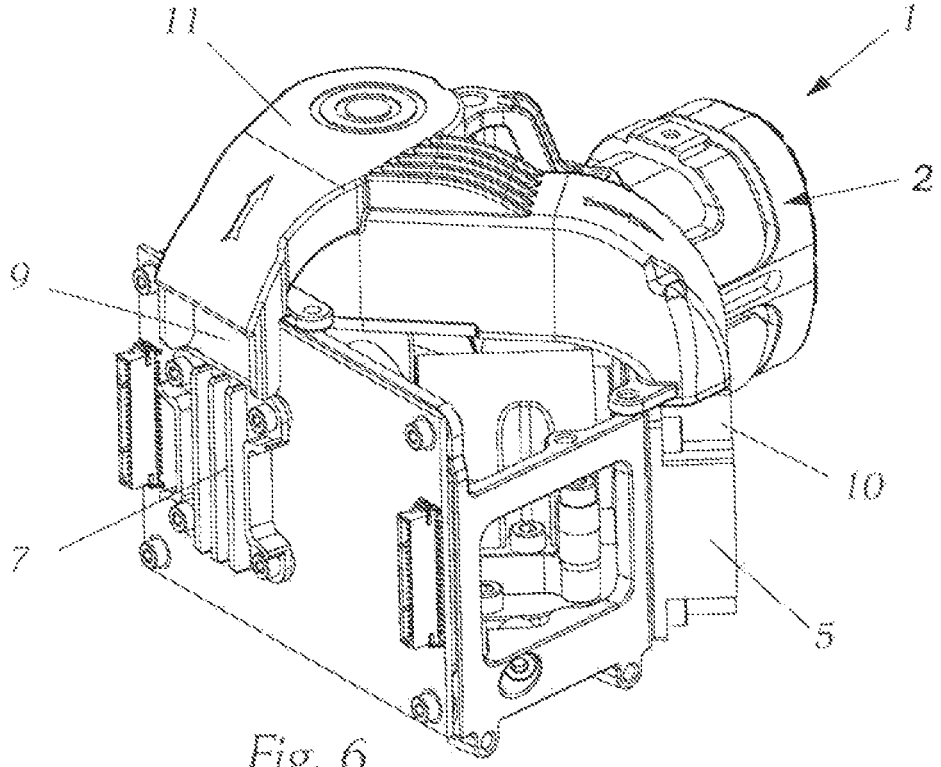
Figure 7:
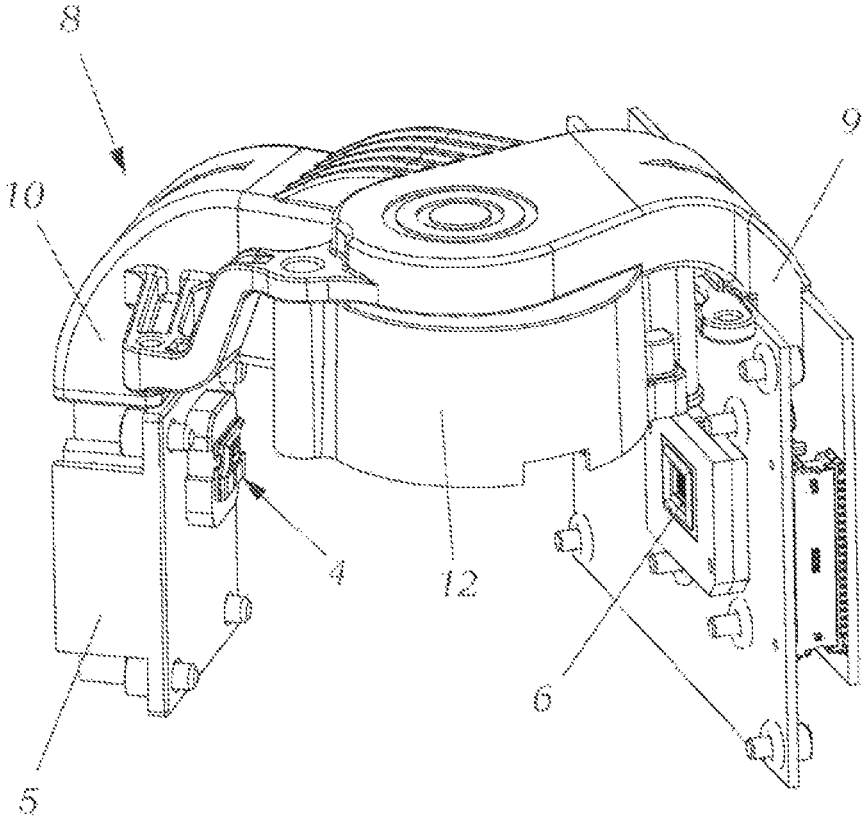

The invention and its advantages will be described in detail hereinafter with reference to non-restrictive examples which are illustrated in the appended drawings. In the drawings:

FIG. 1 shows a perspective view from the front of a lighting unit according to the invention, FIG. 2 shows a view from above of the lighting unit with the position of section A-A, FIG. 3 shows the lighting unit in section A-A, FIG. 4 shows a perspective view from the side of the lighting unit, FIG. 5 shows a perspective view from behind of the lighting unit with a second board upstream of a heat sink of a mirror module, FIG. 6 shows a perspective view from behind of the lighting unit without the second board upstream of a heat sink of a mirror module, FIG. 7 shows a perspective view from upstream of the cooling system.

An exemplary embodiment of the invention is now explained in detail with reference to FIG. 1. In particular, the important parts for the lighting unit according to the invention are shown, wherein it is clear that a lighting unit also contains many other parts which enable an appropriate use in a headlamp in a motor vehicle such as, in particular a passenger car or a motorcycle.

FIG. 1 to FIG. 6 show a lighting unit 1 for a motor vehicle in overview and in various perspectives. The light emission generated by a light module 2 is reflected at a mirror module 3 in the emission direction of the lighting unit. The light module 2 comprises a light source 4, preferably a semiconductor light source, for example a power-LED, and a first heat sink 5. The first heat sink 5 and the light source 4 are connected to one another in a thermally conductive manner, for example through a direct mechanical contact of these two components.

The mirror module 3 comprises a mirror unit and a second heat sink 7. The mirror unit preferably comprises a digital or analogue micro-mirror array (AMD, analog micro mirror device or DMD, digital micro mirror device). The second heat sink 7 and the mirror unit 6 are connected to one another in a thermally conductive manner, for example through a direct mechanical contact of these two components.

In order to remove the heat generated by the light emission, a cooling system 8 is arranged in the lighting unit 1 which comprises an inlet 9, an outlet 10, a line 11, a flow unit 12, a cooling medium, here ambient air, a first cooling sink and a second cooling sink.

The inlet 9 and the outlet 10 are connected by the line 11 and the flow unit 12 in this exemplary embodiment a fan, is inserted in the line 11 in order to produce a flow of the cooling medium in the line 11.

In this case, the cooling medium is sucked in through the inlet and expelled again through the outlet 10 and the first cooling sink is formed by the first heat sink 5 of the light module 2 and the second cooling sink is formed by the second heat sink 7 of the mirror module 3, wherein the first cooling sink is arranged downstream of the second cooling sink.

The flow unit 12 is inserted in the line 11 between the first heat sink 5 and the second heat sink 7 and the first heat sink 5 is arranged downstream of the outlet 10 in such a manner that the first heat sink 5 is cooled by the expelled cooling medium. The second heat sink 7 is arranged upstream of the inlet 9 in such a manner that the second heat sink 7 is cooled by the sucked-in cooling medium.

The first heat sink 5 of the light module 2 is here structurally separated from the second heat sink 7 of the mirror module 3.

FIG. 7 shows a detailed view of the components of the cooling system 8 of the lighting unit 1. For a better understanding no holder and no imaging optics are shown. What is shown is the light source 4 with the first heat sink 5, the mirror unit 6, the inlet 9, the outlet 10 and the fan as flow unit 12.

REFERENCE LIST

1 Lighting unit
2 Light module
3 Mirror module
4 Light source
5 First heat sink of light module
6 Mirror unit
7 Second heat sink of mirror module
8 Cooling system
9 Inlet
10 Outlet
11 Line
12 Flow unit

The invention claimed is:

1. A lighting unit (1) for a motor vehicle, the lighting unit comprising:

a light module (2); and a mirror module (3), wherein the mirror module (3) is adapted to reflect light emission produced by the light module (2) in an emission direction of the lighting unit (1), wherein:

the light module (2) comprises at least one light source (4) connected in a thermally conductive manner to a first heat sink (5), the mirror module (3) comprises a mirror unit (6) connected in a thermally conductive manner to a second heat sink (7), the lighting unit further comprises a cooling system (8) which comprises at least one inlet (9), at least one outlet (10), at least one line (11), at least one flow unit (12), a cooling medium, a first cooling sink and a second cooling sink, wherein the at least one inlet (9) and the at least one outlet (10) are connected by the at least one line (11) and the at least one flow unit (12) is inserted into the line (11) and configured to produce a flow of the cooling medium in the line (11) and thereby suck in the cooling medium through the at least one inlet (9) and expel the cooling medium through the at least one outlet (10), and the first cooling sink is formed by the first heat sink (5) of the light module (2) and the second cooling sink is formed by the second heat sink (7) of the mirror module (3), wherein the first cooling sink is arranged downstream of the second cooling sink, and the second heat sink (7) is arranged upstream of the at least one inlet (9) in such a manner that the second heat sink (7) is cooled by the sucked in cooling medium.

2. The lighting unit (1) according to claim 1, wherein the at least one flow unit (12) is disposed in the at least one line (11) between the first heat sink (5) and the second heat sink (7).

3. The lighting unit (1) according to claim 1, wherein the first heat sink (5) is disposed in the at least one line (11) upstream of the at least one outlet (10).

4. The lighting unit (1) according to claim 1, wherein the first heat sink (5) is arranged downstream of the at least one outlet (10) in such a manner that the first heat sink (5) is cooled by the expelled cooling medium.

5. The lighting unit (1) according to claim 1, wherein the second heat sink (7) is disposed in the at least one line (11) downstream of the at least one inlet (9).

6. The lighting unit (1) according to claim 1, wherein the at least one line (11) of the cooling system (8) runs through the first heat sink (5) of the light module (2) or rests upon the first heat sink.

7. The lighting unit (1) according to claim 1, wherein the at least one line (11) of the cooling system (8) runs through the second heat sink (7) of the mirror module (3) or rests upon the second heat sink.

8. The lighting unit (1) according to claim 1, wherein the first heat sink (5) of the light module (2) is structurally separated from the second heat sink (7) of the mirror module (3).

9. The lighting unit (1) according to claim 1, wherein the cooling medium is air and the at least one flow unit (12) is a fan.

10. The lighting unit (1) according to claim 1, wherein the cooling medium is a cooling liquid or oil and the at least one flow unit (12) is a pump.

11. The lighting unit (1) according to claim 1, wherein the light module (2) comprises at least one semiconductor light source.

12. The lighting unit (1) according to claim 1, wherein the mirror unit (6) comprises a digital or analogue micro-mirror array.

13. The lighting unit (1) according to claim 11, wherein the semiconductor light source comprises at least one power LED or at least one semiconductor laser.

* * * * *